US011213083B2

(12) United States Patent
Patton

(10) Patent No.: US 11,213,083 B2
(45) Date of Patent: Jan. 4, 2022

(54) CORSET

(71) Applicant: Angela Marie Patton, Edmond, OK (US)

(72) Inventor: Angela Marie Patton, Edmond, OK (US)

( * ) Notice: Subject to any disclaimer, the term of this patent is extended or adjusted under 35 U.S.C. 154(b) by 567 days.

(21) Appl. No.: 16/350,422

(22) Filed: Nov. 15, 2018

(65) Prior Publication Data

US 2019/0231011 A1 Aug. 1, 2019

Related U.S. Application Data

(60) Provisional application No. 62/709,717, filed on Jan. 29, 2018.

(51) Int. Cl.
*A41F 1/04* (2006.01)
*A41C 1/12* (2006.01)

(52) U.S. Cl.
CPC . *A41F 1/04* (2013.01); *A41C 1/12* (2013.01)

(58) Field of Classification Search
CPC .. A41C 1/12; A41C 1/00; A41C 1/006; A41F 1/04; A61F 5/00; A61F 5/028; A61F 5/03; A61F 5/02; A61F 5/022; A61F 5/24
USPC ..... 128/876; 602/19
See application file for complete search history.

(56) References Cited

U.S. PATENT DOCUMENTS 321,145 A * 6/1885 Spencer ..... A43C 3/02 24/713.5
321,146 A * 6/1885 Spencer ..... A43C 3/02 24/713.5
772,926 A * 10/1904 Colton ..... A43C 1/00 24/715.1
880,736 A * 3/1908 Hoskins ..... A41F 1/04 450/142
1,355,207 A * 10/1920 Wright ..... A41F 1/04 450/142
1,464,217 A * 8/1923 Petersen ..... A41F 1/04 450/142
1,534,774 A * 4/1925 Edmiston ..... A61F 5/03 450/96
2,036,484 A * 4/1936 Le May ..... A61F 5/03 450/119
2,155,305 A * 4/1939 Corsa ..... A41F 1/04 450/119
2,410,083 A * 10/1946 Kispert ..... A41F 1/04 450/138

(Continued)

FOREIGN PATENT DOCUMENTS

FR 572636 A * 6/1924 ..... A41F 1/04
FR 576568 A * 8/1924 ..... A61F 5/03

*Primary Examiner* — Alissa J Tompkins
*Assistant Examiner* — Brieanna Szafran
(74) *Attorney, Agent, or Firm* — Randal D. Homburg

(57) ABSTRACT

A corset or lingerie item features and improved dual level tightening system which allows a wearer to apply the corset or lingerie item without the assistance of another person by the inclusion of a rear cinching, dual level improved tightening system that operates to tighten the corset or lingerie item around the lower torso from the front of the garment, adjusted by the wearer to a suitable level of comfort level determined by the wearer, the dual level tightening system providing lower torso support and a slenderizing effect while not restricting general lumbar movement and flexibility.

5 Claims, 3 Drawing Sheets

(56) References Cited

U.S. PATENT DOCUMENTS

| | | | | |
|---|---|---|---|---|
| 2,554,337 | A * | 5/1951 | Lampert | A61F 5/028 606/237 |
| 4,508,110 | A * | 4/1985 | Modglin | A61F 5/022 2/44 |
| 6,044,491 | A | 4/2000 | Emery | |
| 6,213,968 | B1 * | 4/2001 | Heinz | A61F 5/028 602/19 |
| 6,322,529 | B1 | 11/2001 | Chung | |
| 7,001,348 | B2 | 2/2006 | Garth | |
| 7,186,229 | B2 | 3/2007 | Schwenn | |
| D636,494 | S | 4/2011 | Garth | |
| 8,372,023 | B2 * | 2/2013 | Garth | A61F 5/028 602/19 |
| 9,066,792 | B2 | 6/2015 | Garth | |
| 9,339,406 | B2 | 5/2016 | Burke | |
| D799,907 | S | 10/2017 | Burke | |
| 9,795,500 | B2 * | 10/2017 | Ingimundarson | A61F 5/0102 |
| 2005/0251074 | A1 | 11/2005 | Latham | |
| 2009/0082707 | A1 | 3/2009 | Rumsey | |
| 2009/0204042 | A1 * | 8/2009 | Park | A61F 5/028 602/19 |
| 2010/0168630 | A1 * | 7/2010 | Cropper | A61F 5/30 602/19 |
| 2010/0217167 | A1 | 8/2010 | Ingimundarson | |

* cited by examiner

CORSET

CROSS REFERENCE TO RELATED APPLICATIONS

Applicant claims the benefit of Provisional Patent No. 62/709,707 filed by the same inventor on Jan. 29, 2018.

I. BACKGROUND OF THE INVENTION

1. Field of Invention

A corset or lingerie item features an improved dual level tightening system which allows a wearer to apply the corset or lingerie item without the assistance of another person by the inclusion of a rear cinching, dual level improved tightening system that operates to tighten the corset or lingerie item around the lower torso from the front of the garment, adjusted by the wearer to a suitable degree of comfort level determined by the wearer, the improved dual level tightening system providing lower torso support and a slenderizing effect while not restricting general lumbar movement and flexibility.

2. Description of Prior Art

A preliminary review of prior art patents was conducted by the applicant which reveals prior art patents in a similar field or having similar use. However, the prior art inventions do not disclose the same or similar elements as the present corset, nor do they present the material components in a manner contemplated or anticipated in the prior art. Very few prior art patents were found which identify garments relative to corsets or lingerie.

An undergarment dressing aid, appearing as a corset type garment, was disclosed in U.S. Pat. No. 6,044,491 to Emery. It is a tubular sleeve which assists a user in putting on an undergarment with hard to reach fasteners. There were several patents which deal with devices having rear lacings for therapeutic application, including back support braces and the like. In U.S. Pat. No. D799,707 and U.S. Pat. No. 9,339,406 to Burke, a tightening system is disclosed involving shaped panels intended to be used within a back brace. In another design patent to Garth, U.S. Pat. No. D636,494, a lumbar belt is disclosed which wraps around a user and involves a corded tightening device. Similar corded lumbar supports are disclosed in U.S. Patent Application Pub. No. 2010/0217167 to Ingimundarson, 2009/0082707 to Rumsey and 2005/02501074 to Latham. These involve braces with return guides to draw a lumbar support belt tighter around a person wearing the lumbar supports at a single level. Several U.S. patents also disclose similar lumbar support belts which incorporate corded draw systems to tighten the lumbar support around a user, including U.S. Pat. Nos. 9,066,792, 8,372,023 and 7,001,348 to Garth, U.S. Pat. No. 7,186,229 to Schwenn, U.S. Pat. No. 6,322,529 to Chung and U.S. Pat. No. 6,213,968 to Heinz, the Heinz patent two juxtaposed segments involving a plurality of tensioning cables instead of lacing.

II. SUMMARY OF THE INVENTION

Lingerie and corsets, are designed to be applied to the torso for slenderizing and also for other aesthetical appeal to a wearer. They are provided for recreational purposes as well as for posture improvement and enhanced aesthetic appeal of the wearer. Corsets are manufactured or sold by retail lingerie companies and generally embody a fitted garment that covers in whole or in part the area of the body that runs from the hips to the breast area, or just below the breasts. For purposes of a shortened reference, the corset and lingerie will be collectively referred to as the "garment".

The garment generally fastens from the front when applied. Subsequently, the garment is tightened around the lumbar area to fit the wearer and provide a narrowing of the abdominal area. Most often, this requires tightening of the garment from the rear and nearly always requires the assistance of a second person behind the wearer to conduct or assist in the tightening process. The present improvement provides a rear cinching, dual level improved tightening system that operates to tighten the corset or lingerie item around the lower torso from the front of the garment, adjusted by the wearer to a suitable degree of comfort level determined by the wearer, while allowing generous flexibility and movement of the lumbar area.

III. DESCRIPTION OF THE DRAWINGS

The following drawings are submitted with this utility patent application.

IV. DESCRIPTION OF THE PREFERRED EMBODIMENT

Figure 1:
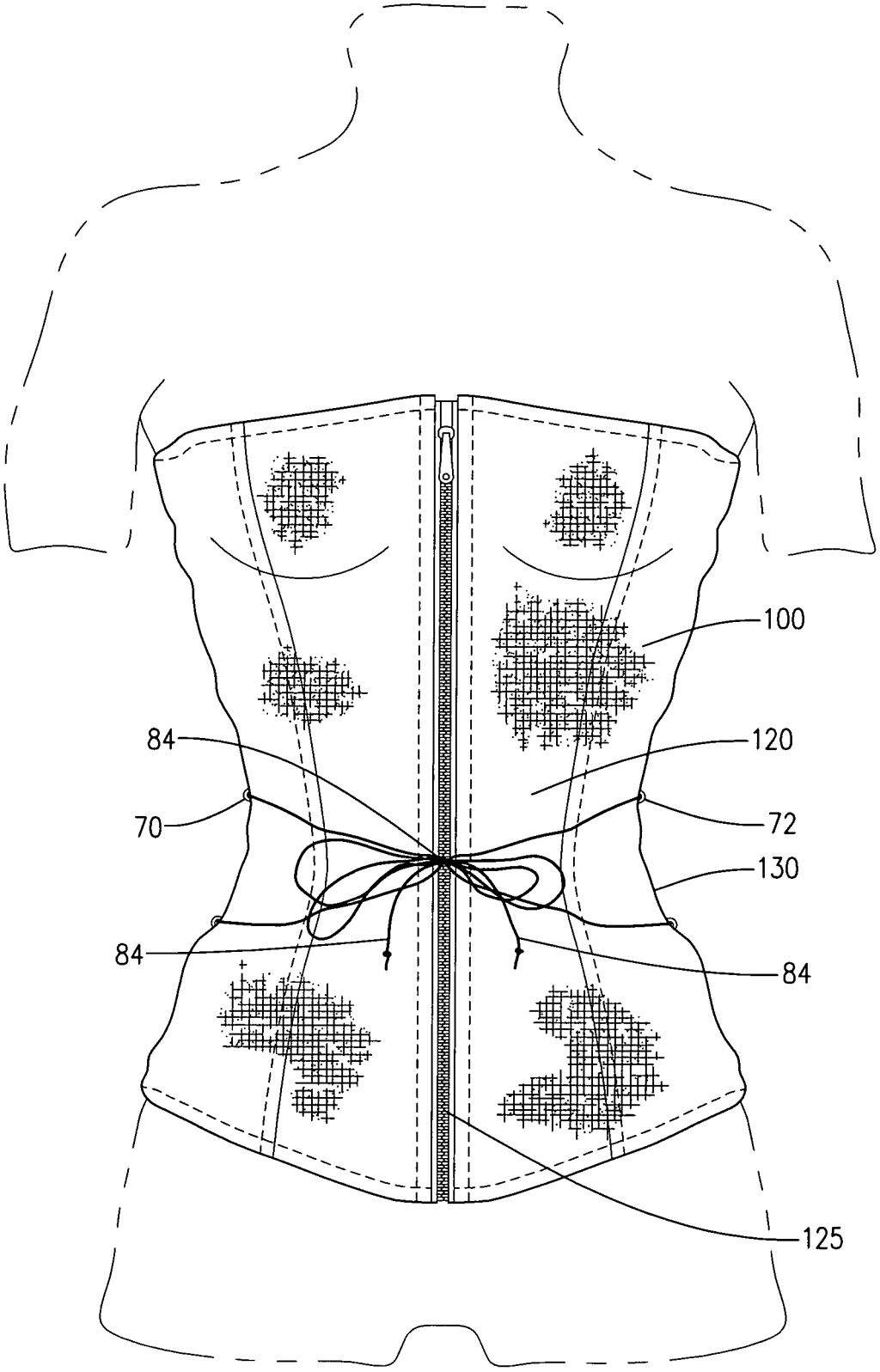
FIG. 1 is a front view of the improved dual level tightening system applied to a corset lingerie garment worn by a person, the person shown in phantom line.

An improved dual level tightening system 10, as demonstrated in FIGS. 1-3, which allows a wearer to apply the corset or lingerie item (hereinafter "corset lingerie 100") without the assistance of another person to accomplish rear cinching, the dual level improved tightening system operating to tighten the corset or lingerie item around the lower torso from the front of the corset lingerie 100 or by the wearer from the rear, combining a corset lingerie 100 that has a front closure 125, commonly seen in other corset lingerie garments, the improvement comprising a first pair of upper fabric reinforcement panels 20, FIGS. 2-3, attaching to the rear 110 of the corset lingerie 100 and a second pair of lower fabric reinforcement panels 40 also attaching to the rear 110 of the corset lingerie 100 across an open rear seam 115 of the corset lingerie 100. The upper fabric reinforcement panels 20 are oriented across from one another in mirror image as are the lower fabric reinforcement panels 40, as seen in FIG. 3. The upper fabric reinforcement panels 20 are located above a region of primary bend A of the lumbar spine (herein defined as a location between L5 and T11), while the lower fabric reinforcement panels 40 are located below the primary bend A.

Figure 2:
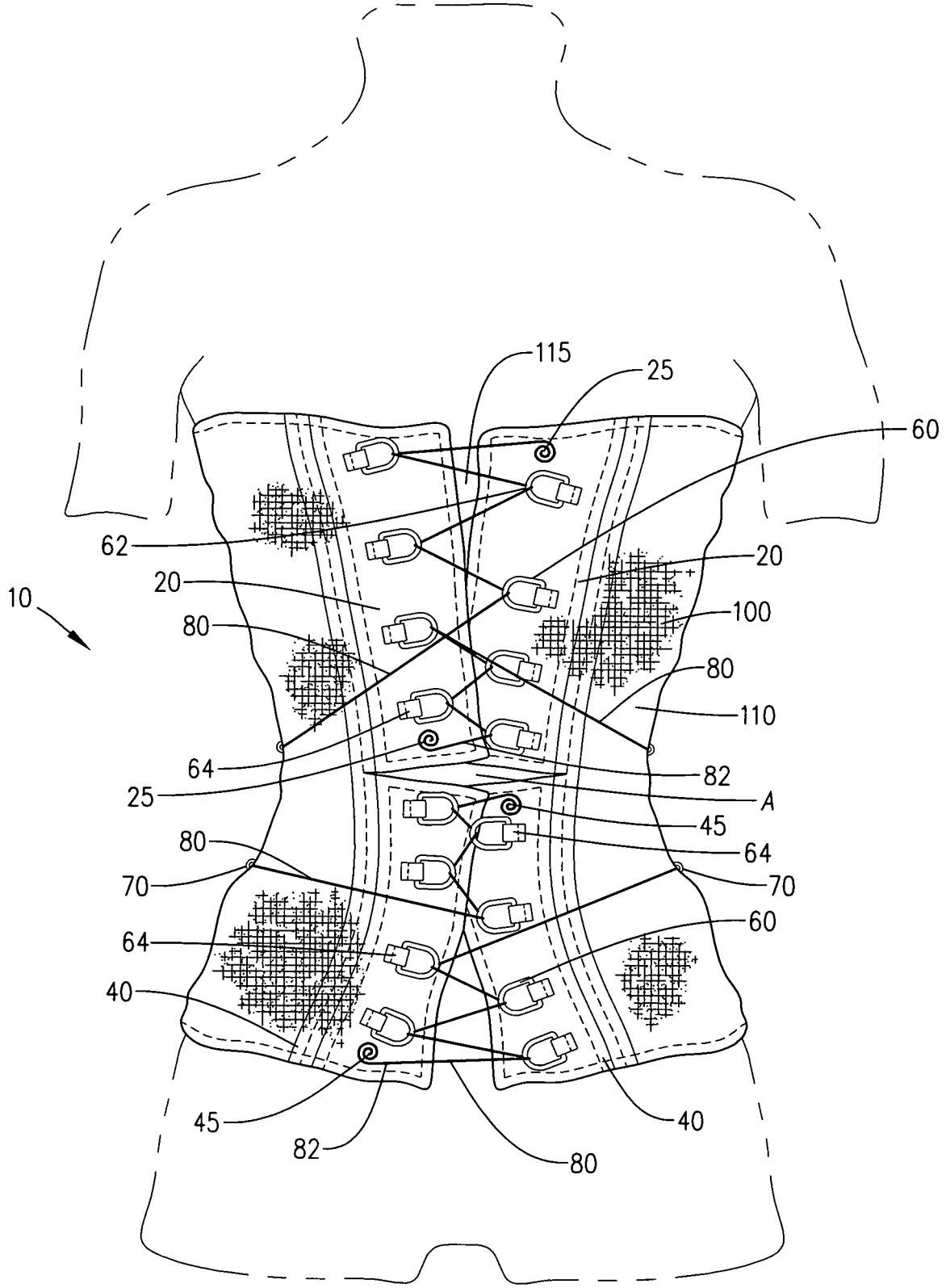
FIG. 2 is a rear view of the improved dual level tightening system applied to a corset lingerie garment worn by a person, the person shown in phantom line.
Figure 3:
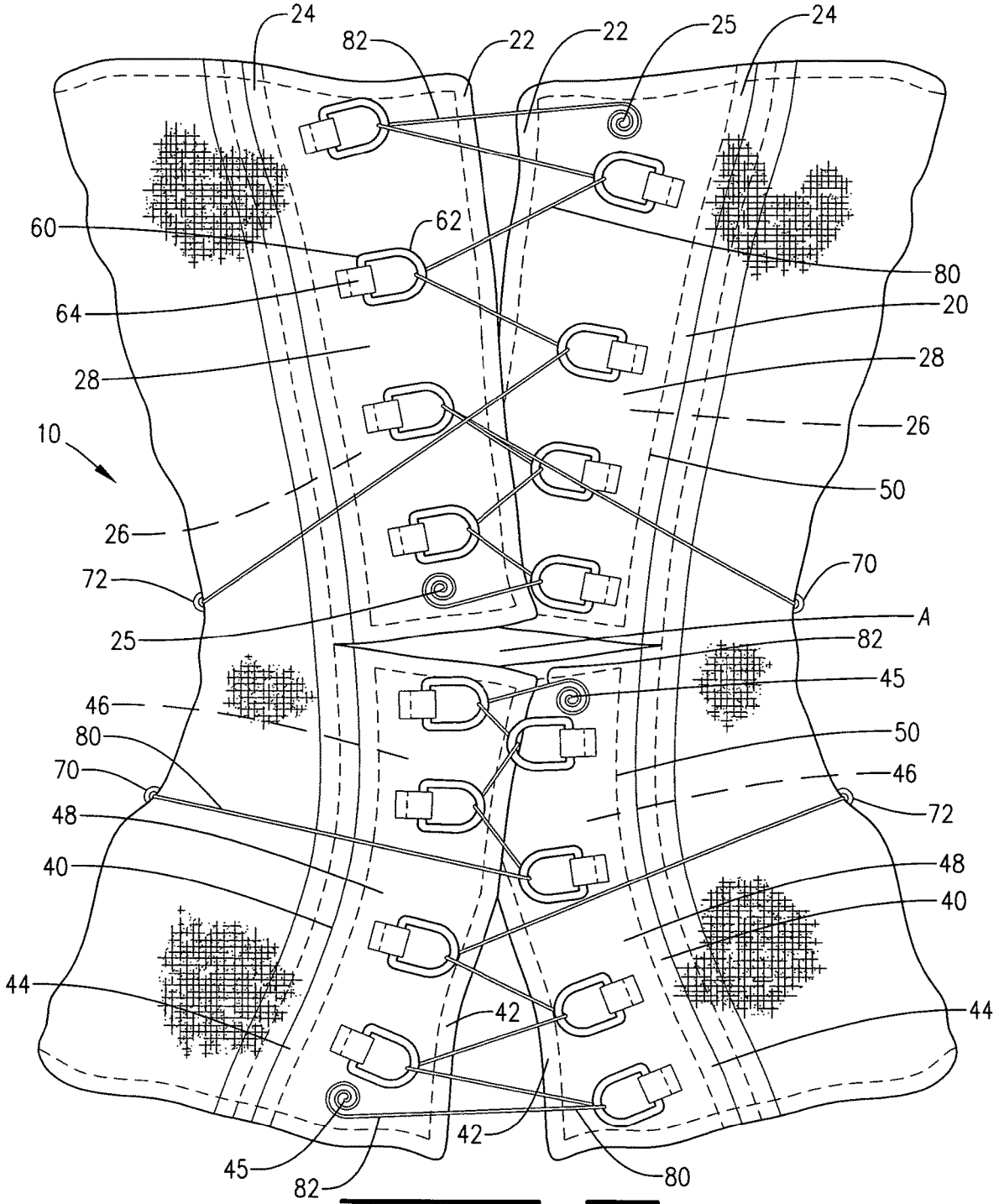
FIG. 3 is the improved dual level tightening system applied to a corset lingerie garment indicating the laces and a preferred arrangement of the turnstiles on each upper fabric reinforcement panel and each lower fabric reinforcement panel.

Each upper and lower fabric reinforcement panel 20, 40, further defines an inner margin 22, 42, an outer margin 24, 44, a inner surface 26, 46, an outer surface 28, 48, and a lace anchor 25, 45, with the inner surfaces 26, 46, attaching to the rear 115 of the corset lingerie 110 by adhesion, stitching 50, FIG. 2, or other common garment attaching means 50. The outer surfaces 24, 44, of each reinforcement panel 20, 40, further defines a plurality of spaced lacing turnstiles 60, FIGS. 2-3, extending above the respective outer surfaces 28. The corset lingerie 100 further defines at least one lateral lace keeper 70 on the lateral margins 130 of the corset lingerie 100 at a level on the corset lingerie 100 in line with the uppermost lacing turnstile 60 of each lower fabric reinforcement panel 40, and the lowermost lacing turnstile 60 of each upper fabric reinforcement panel 20, as seen in FIGS. 2-3. The outer margins 24, 44, of each paired fabric reinforcement panel 20, 40, are directed toward the lateral margins 130 of the corset lingerie 100, while the inner margins 22, 42, of each paired fabric reinforcement panels 20, 40, are directed towards one another along the rear 110 of the corset lingerie 100 across the open rear seam 115.

A lace 80 defines a first end 82 attached to a respective lace anchor 25, 45, as shown in FIG. 3, and a second end 84 which is the terminal end as shown in FIG. 1. The attachment of each lace 80 to the lace anchor 25, 45, may be tied, knotted, threaded, looped or otherwise attached in a removable manner, with replacement of the lace 80 possible in the event a lace is damaged or broken. The second end 84 is the end which is grasped by the wearer and secured to another second end 84 of a lace threaded through a parallel fabric reinforcement panel 20, 40. A pair of laces 80 are further threaded through the paired sets of lacing turnstiles 60 in a cross-cross pattern between each parallel upper fabric reinforcement panel 20, with an independent lace connecting the paired upper reinforcement panels and a separate pair of laces threaded through respective turnstiles 60 in a cris-cross pattern connecting the paired lower fabric reinforcement panels 40, FIG. 3.

It would be preferred that each reinforcement panel 20, 40, be made of a durable and non-deformable material, unlike that of the remainder of the corset lingerie 100, such materials including canvas, leather, polymeric materials which have no waft or wane, and that they either integrate or secure upon or onto the rear 110 of the corset lingerie 100 material. Each lacing turnstile 60 is nondeformable, and should have a low profile, with smooth surfaces, in a preferred embodiment as shown in FIG. 3. It is the intent of each lacing turnstile to not affect the comfort of the wearer in a prone position or any other position.

The lacing turnstiles 60 are essential in the lacing and tightening of the upper and lower fabric reinforcement panels 20, 40, across the open rear seam 115 to secure the corset lingerie 100 to the wearer. Ideally, the lacing turnstiles 60 will retain each respective threaded lace 80 and allow for the lace 80 to be redirected with minimal friction during movement, also having a means of attachment to the respective reinforced panel 20, 40, to which each lacing turnstile 60 is attached and aligned. FIG. 3 is provided as an embodiment that provides the lacing turnstile 60 and a respective turnstile tab representing an attachment means 64 to each respective fabric reinforcement panel 20, 40, but this embodiment is provided only to express a version of the lacing turnstile 60 and attachment means 64, and not to place any limitations as to the lacing turnstile 60 or attachment means 64 which could be used for the purposes of the system 20.

A central taper 62 is meant to center each lace 80 within each lacing turnstile 60, as seen in FIG. 3. The turnstile tab/attachment means 64 retains each turnstile 80 to allow the turnstile 80 to be indirectly sewn on the fabric reinforcement panel 20, 40. This embodiment is shown to prevent the lace 80 from disengaging the turnstile 80 when tension is released on the lace 80, yet allows each lace 80 to be tightened with lessened restrictions by the turnstile 60 during tensions applied upon the lace 80. The turnstile 60 is meant to encourage the back-and-forth threading demonstrated in FIG. 3, with as little interruption, interference or friction upon the lacing 80 across the open rear seam 115.

Each lateral lace keeper 70 further defines a passage 72 through which each lace is threaded and positioned at the lateral margins 130 of the corset lingerie 100 as seen in FIGS. 1-3, maintaining second ends 84 of each lace 80 along the lateral margin 130 of the corset lingerie 100 for front access by the wearer when the corset lingerie 100 is being applied and subsequently tightened from the front 120. The placement of the lateral lace keeper 70 vertically on the corset lingerie 100 is merely suggestive, with each lateral lace keeper 70 placed along a vertical access either higher or lower than shown in FIGS. 1-3. The placement of the lateral lace keepers 70 is rendered in FIG. 1, so that all four second ends 84 of each lace 80 can be gathered together and commonly tied together at a singular location. The laces 80 may be tied together in pairs, upper laces 80 together and lower laces 80 together, or an upper lace 80 tied to an opposing lower lace 80. The second end 84 attachment may be below the bust, in the middle, around the hips or wherever the designer of the integrated basic improved dual level tightening system 20 is preferred.

The lace 80 is generally a corded material that is both strong and flexible with a smooth outer surface, similar to a rounded shoe lace designed for repeated tensioning without deformation and little amount of stretch. Materials suited for use as laces 80 may include fabric or natural fiber cords, ribbons, webbing, nylon, polymeric blended cording, or other flexible cordage, rope or string, although comfort should be a factor in the selection of the lace material. There are at least two upper laces 80 and a separate pair of lower laces 80. Each lace 80 is threaded in a cris-cross pattern across the open rear seam 115, similar to that shown in FIG. 3, between each paired upper set of fabric reinforcement panels 20 and each paired lower set of fabric reinforcement panels 40. The laces 80 between the set of upper fabric reinforcement panels 20 is shown in FIG. 3 as being laced opposite, as are the laces between the set of lower fabric reinforcement panels 40. It would be best suited to align the lateral lace keepers 70 accordingly, to attempt to orient each keeper at a level to provide the exiting portion of each lace 80 as horizontal as possible with the last turnstile 60 at each side of the lace 80 to enhance the draw of the lace and optimize the amount of tension which could be applied without deforming the corset lingerie 100.

The laces 80 are applied to the corset lingerie prior to wear. The corset lingerie 100 is then applied in the same manner as any other corset lingerie 100. Once secured, the wearer then holds the second ends 84 of a paired laces 80 and pulls the second ends 84 towards one another in front of the corset lingerie 100. The laces 80, turnstiles 60 and keepers 70 combine to allow the user to optimize the amount of force of the draw on the each lace 80 through the combination turnstile 60 system similar to that realized in a shoe or in some prior art braces disclosed above, but in a manner and by use of distinguished elements from those found in the prior art. The laces 80 may be drawn first upon the paired upper fabric reinforcement panels 20 to secure the upper portion of the corset lingerie around the ribs, with the second laces between the paired lower reinforcement panels 40 around the hips, or reverse. The second ends 84 of the laces may be tied together in a bow, FIG. 1, or secured by a retaining means provided on the ends of the laces 80 that allows them to be joined and disjoined in the front by the user, not shown. Examples of alternative retaining means can be hook and loop connectors, mechanical fasteners which have adjustable locations upon each lace end, or some other type of securing locations on the front 120 of the corset lingerie 100 to which each second end 84 attaches independently or in common. The laces may also be drawn and tightened at the rear 110 of the corset lingerie 100.

Ideally, the number of turnstiles 60 has been found to be four per lace 80, this ideally suitability determined by cost and finding that a 4:1 tightening ratio seems to be adequate to secure the corset lingerie 100 to a desired degree of comfort and fit, require less amount of force necessary to achieve that comfort and fit, to economically provide the corset lingerie 100 at an affordable cost to the consumer and also to adequately locate the number of turnstiles 60 in the garment without creating a crowding of turnstiles 60 or interference between adjacent turnstile operations. As the primary consideration behind the improved corset lingerie 100 is comfort, flexibility and ease of application, especially from the front of the garment, the 4:1 turnstile 60 to lace 80 most suitably meets those objectives.

The lace 80 is applied to the corset lingerie prior to wear. The corset lingerie 100 is then applied in the same manner as any other corset lingerie 100, preferably by placing the corset lingerie 125 around the waist and applying the front closure 125. Once the front closure 125 is secured, the wearer then grabs the second ends 84 of a pair of laces 80 and pulls the second ends 84 towards one another in front 120 of the corset lingerie 100. The lace 80, turnstiles 60 and lateral lace keepers 70 combine to allow the user to optimize the amount of force of the draw on the each lace similar to that realized in a shoe or in some prior art braces disclosed above, but in a manner and by use of distinguished elements from those found in the prior art. The laces 80 may be drawn first upon the paired upper reinforcement panels 20 to secure the portion of the corset lingerie 100 around the ribs, with the other laces between the paired lower reinforcement panels 40 around the hips, or reverse. The second ends 84 of the laces 80 are tied together in a bow or secured by another retaining means provided on the second ends 84 of the laces 80 that allow them to be joined and disjoined in the front 120 by the user. Examples of retaining means can be hook and loop connectors, mechanical fasteners which have adjustable locations upon each lace end, or alternatively some type of securing locations on the front of the corset lingerie to which each lace end attaches independently or in common.

Once secured, the wearer still maintains the ability to bend at the waist and lumbar region without impeding lumbar flexibility, due to the dual level upper and lower fabric reinforcement panels between which the primary bend A is located when each paired reinforced panel is secured together upon the corset lingerie 100. The tension will vary by size and shape of the wearer, thus requiring each wearer to select a size and shape appropriate for their body shape and size. The corset lingerie 100 may be provided in an unlimited variety of colors, fabric selections, texture, design, level of modesty, and desired accessibility to other body parts as envisioned by each individual wearer. The only common requirement is the inclusion of the disclosed improvements to each chosen variety.

Although the embodiments of the front or rear cinching, dual level improved tightening system 20 that operates to tighten the corset or lingerie item around the lower torso from the front of the corset have been described and shown above, it will be appreciated by those skilled in the art that numerous modifications may be made therein without departing from the scope of the invention as herein described.

I claim:

1. A dual level corset tightening system configured to provide a wearer with application of a fashionable corset around a waist of the wearer without the assistance of another person to accomplish cinching, the dual level corset tightening system comprising:

a pair of upper reinforcement panels provided across an open rear seam on a rear of said corset, each said upper reinforcement panel defining an inner margin facing said open rear seam and said inner margin of the other paired upper reinforcement panel, an outer margin facing away from said open rear seam, a pair of lace anchors, an inner surface attached to said corset by stitching or by another attachment, and an outer surface, said upper reinforcement panels configured to be located upon said corset above the wearer's waist;

a pair of lower reinforcement panels provided across said open rear seam of said corset, each said lower reinforcement panel defining an inner margin facing said open rear seam and said inner margin of the other paired lower reinforcement panel, an outer margin of the pair of lower reinforcement panels facing away from said open rear seam, a pair of lace anchors of the pair of lower reinforcement panels, an inner surface of the pair of lower reinforcement panels attached to said corset by stitching or by another attachment, and an outer surface of the pair of lower reinforcement panels, said lower reinforcement panels configured to be located upon said corset below the wearer's waist;

a plurality of spaced lacing turnstiles each respectively attached to each said upper and lower reinforcement panels in horizontal alignment;

a lateral lace keeper attached respectively on an opposing lateral margin of said corset;

two pairs of laces, wherein each lace within said two pairs of laces defining a first end secured to a respective lace anchor of each said upper and lower reinforcement panel, and further defining a second end laced in a cris-cross manner through each respective said lacing turnstile across said open rear seam of said corset, said second end threaded through said lateral lace keeper closest to where said second end exits a respective said lacing turnstile, each said respective second end configured to be retained for access by said wearer along said lateral margins of said corset, wherein said second ends are drawn towards one another across a front of said corset and tied together or otherwise connected to maintain the corset with a snug fit to the wearer while allowing the wearer to bend and move with a reduced restriction.

2. The dual level corset tightening system of claim 1, further comprising:

said corset having a front surface defining a front closure which is secured prior to application of force to the second end of each lace;

each said lateral lace keeper defining a passage through which each said respective lace is configured to be threaded and retained along a respective said lateral margin of said corset; and wherein the attachment for each said respective lacing turnstile is a turnstile tab, wherein said first end of each said lace is tied, knotted, threaded, looped or otherwise attached to the corset in a removable manner, with replacement of each said lace possible in the event if any of said laces are damaged or broken and, wherein each pair of said two pairs of laces are threaded through respective, matched sets of said lacing turnstiles in said cris-cross manner across said open rear seam configured to secure said corset to said wearer without affecting bending movement of said wearer, one pair of said two pairs of laces threaded through said lacing turnstiles in said cris-cross manner between each parallel said upper fabric reinforcement panels, connecting one said upper fabric reinforcement panel to the other said upper fabric reinforcement panel, and another pair of said two pairs of laces threaded through said lacing turnstiles in said cris-cross manner between each parallel said lower fabric reinforcement panels, connecting one said lower fabric reinforcement panel to the other said lower fabric reinforcement panel.

3. The dual level corset tightening system of claim 1, further comprising:

each said lacing turnstile is non-deformable and defines a central taper to redirect each said lace through each respective said lacing turnstile at an intentional location within each said lacing turnstile and reduce an amount of friction between each respective said lacing turnstile and each respective said lace; and one pair of said two pairs of laces applied to said upper reinforcement panels and attached together independently from another to said pair of said two pairs of laces applied to said lower reinforcement panels.

4. The dual level corset tightening system of claim 1, further comprising wherein each said upper and lower reinforcement panel is made of a durable and non-deformable material selected from a group of fabrics including leather, canvas, polymeric materials, or otherwise provided with no waft or wane to the selected material.

5. The dual level corset tightening system of claim 1, further comprising:

at least two upper laces and a separate pair of lower laces defining said two pairs of laces, each of said at least two upper laces and said pair of lower laces respectively threaded in a cris-cross pattern across said open rear seam between each said pair of upper reinforcement panels and each said pair of lower reinforcement panels, said at least two upper laces between said upper reinforcement panels being laced opposite from high to low said lacing turnstiles or low to high said lacing turnstiles, wherein said pair of lower laces between said lower reinforcement panels being laced opposite from high to low said lacing turnstiles or low to high said lacing turnstiles, and said lateral lace keepers are aligned accordingly to orient each said lateral lace keeper at a level to provide an exiting portion of each lace as horizontal as possible with a last said lacing turnstile at each said lateral margin to readily obtain front access of each said lace wherein a forced tension is configured to be applied without deforming said corset.

* * * * *